US005095836A

United States Patent [19]

Gallagher

[11] Patent Number: 5,095,836

[45] Date of Patent: Mar. 17, 1992

[54] EMERGENCY BULK LIQUID HANDLING SYSTEM FOR VESSELS

[76] Inventor: John J. Gallagher, 2903 Beach Dr., Huntingtown, Md. 20639

[21] Appl. No.: 547,185

[22] Filed: Jul. 3, 1990

[51] Int. Cl.[5] ..... B63B 25/08

[52] U.S. Cl. ..... 114/74 R; 137/172; 137/579; 137/590; 114/72

[58] Field of Search ..... 114/72, 74 R, 73, 211, 114/74 A; 137/172, 578, 579, 590, 615; 210/241, 241.2

[56] References Cited

U.S. PATENT DOCUMENTS

| | | | |
|---|---|---|---|
| 3,693,795 | 9/1972 | Robinson et al. | 210/242.1 |
| 3,757,813 | 9/1973 | Levenberg | 137/578 |
| 3,859,944 | 1/1975 | Warner | 114/74 R |

*Primary Examiner*—Edwin L. Swinehart
*Attorney, Agent, or Firm*—Brady, O'Boyle & Gates

[57] ABSTRACT

An emergency bulk liquid cargo handling system for marine vessels when storage tanks for those liquids have been ruptured and flooded with sea water wherein the liquid cargo handling system is adjustable to provide liquid cargo removal from the flooded tanks regardless of the level of the liquid cargo/water interface in the flooded tank.

5 Claims, 3 Drawing Sheets 10
12
14
16s
16p
18a
18b
18c
18d
18e
20s-a
20c-a
20p-a
20p-b
20p-c
20p-d
24
26
31
32
33
35
42
44

10
14
16p
18c
18d
20p-b
20p-c
20p-d
22
24
26
28
29
32
33

FIG.5
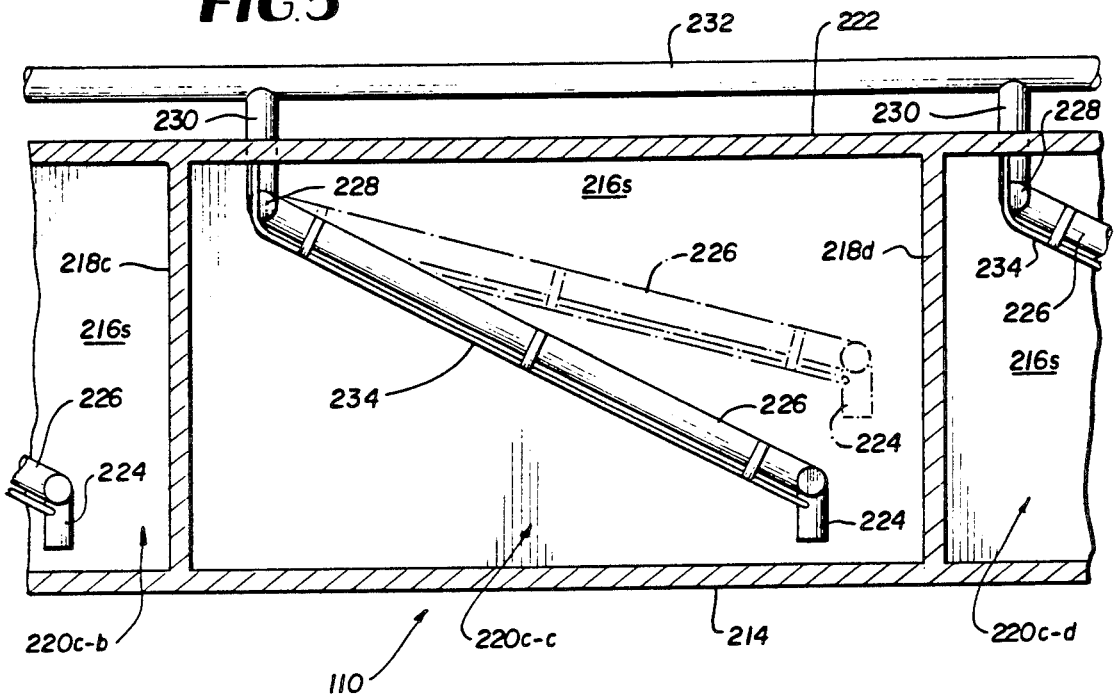
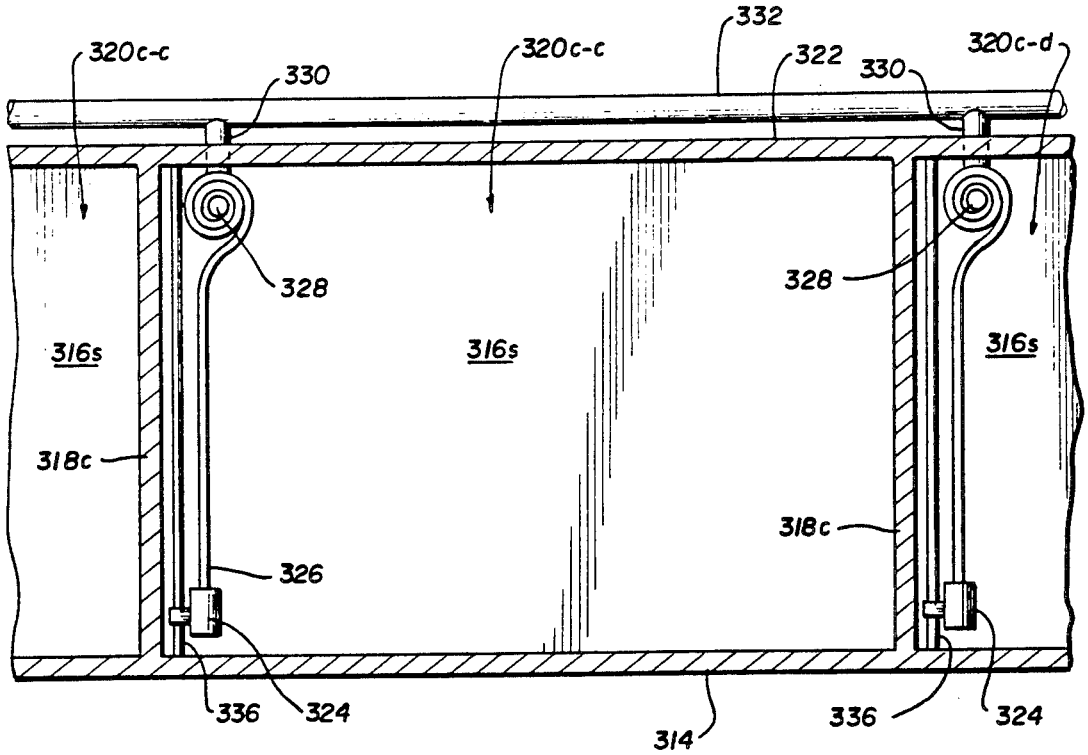
FIG.6

EMERGENCY BULK LIQUID HANDLING SYSTEM FOR VESSELS

BACKGROUND OF THE INVENTION

1. Field of Invention

This invention relates to systems for handling of bulk liquids in vessels in emergencies when storage tanks for those liquids have been flooded. Bulk liquid is carried by all motor and steam vessels as bunker fuel and, in vessels designed for carriage of bulk liquid cargo-(barge or ship), as cargo.

The invention relates in particular to liquid handling systems in all classes of motor and steam vessels but is specifically described hereinafter as it is applied to petroleum cargo-carrying tankvessels.

2. Description of the Prior Art

Most state of the art bulk liquid cargo carrying tankvessels are provided with cargo handling systems which include piping connected to a central, high capacity cargo pump system at one end and to "bellmouth" intakes fixed close to the bottom of each cargo tank for normal cargo removal. Through valves, one or more bellmouth intakes can be connected to the cargo pump system to produce suction in selected tanks for removal of cargo from those tanks for transfer to other tanks or ashore. The bellmouth intakes are located near the bottom of the tank and generally near the aft wall of the tank so that the maximum amount of cargo may be removed from the tank through the cargo pump system. With this arrangement, by trimming the vessel by her stern, the bellmouth intake will remain immersed and capable of withdrawing cargo for the maximum length of time. Cargo remaining is then removed by a lower capacity cargo stripping system.

Another class of tankvessels, the chemical-carrying parcel or "drugstore" ships routinely carrying a variety of different chemicals as cargo. Because these different cargoes require segregation at all times, the cargo system of these vessels is designed with individual piping systems to each tank and individual pumping systems for each tank's piping. The systems, utilize "deep well" submersible pumps located in the bottom of the tank.

When a loaded tankvessel is collided with or goes aground with a hull rupture in way of her cargo tanks, seawater floods into a ruptured tank displacing the cargo in the tank as a function of the level of the highest point of damage in the hull. Where the cargo is lighter than the seawater, as the majority of liquid cargoes are, the displaced cargo, discharged to the sea as a spill, flows out rapidly at first and then gradually decreases in flow rate as the water/cargo interface approaches a natural equilibrium based on relative head between the cargo and sea. This natural equilibrium or "water bottom" is unstable, easily upset by relative motion between the vessel and the sea. Continuing spillage will normally result from wave and current action or from further movement or motion of the ship.

If the cargo system were to be adapted to function in each tank, regardless of the flooded condition of that tank, the size of the spill could be significantly reduced since cargo could be transferred from the holed tank(s) before equilibrium is reached. It would also be of great help if the cargo in the holed tank(s) could be transferred or reduced to a degree that the resulting natural equilibrium is stabilized to prevent further spillage from the vessel caused by relative motion between the vessel and the sea. Such stabilization would also allow more radical movement of the vessel to speed her salvage and removal from further peril.

Because of the configuration of present cargo handling systems, however, the water bottom in a flooded tank will envelope the bellmouth or submersible pump suction intakes, effectively disabling the vessel's cargo pumping system in the flooded tank. Stranded tankers have therefore been required to await the arrival of emergency "over the top" pumping equipment to have cargo in their holed tanks removed or reduced. This has resulted in the loss of all of the cargo whose discharge was required to achieve a natural interface and has involved a substantial delay in rectifying a casualty, prolonging the spillage of cargo and endangering the vessel and remaining cargo by delaying salvage efforts until natural equilibrium in the holed tanks is stabilized. In the EXXON VALDEZ grounding in Alaska in 1989, several days passed before sufficient emergency "over the top" pumping capacity arrived and was rigged to stabilize the several water bottoms created in that vessel by the grounding, substantially prolonging the duration (and increasing the ultimate quantity) of spillage from the vessel and the length of time she remained on her strand and vulnerable to the elements.

A device intended to accomplish similar objectives to those of the present invention is disclosed in U.S. Pat. No. 4,389,959. This device proposes a system to offload cargo from a holed vessel tank by means of an additional, independent cargo handling system fixed at a designated distance above the hull bottom and the vessel's indigenous cargo handling system. Aside from the added expense, weight and increased complexity of a system requiring an additional cargo handling system with redundant piping, cargo pump and valving, this system also introduces increased maintenance effort and increased probabilities of failure inherent in a system that would normally be used only in an emergency.

As was discussed above, the inventor is also aware of chemical-carrying "drugstore" ship tankvessels in standard operation today which utilize individual submersible pumps in cargo tanks for cargo handling. These systems, with their pumps fixed and relatively immobile, cannot function in the manner of the present invention.

SUMMARY OF THE INVENTION

This invention relates to a adaptation of a tankvessel liquid cargo handling system to make them operable to remove cargo regardless of the flooded condition of a cargo tank.

The invention provides a liquid cargo-carrying tankvessel cargo handling system which can adjust to provide cargo removal from flooded cargo tanks regardless of the level of interface with the water bottom formed in the tank.

In a preferred embodiment, the invention provides means adjust the cargo intake vertically in each tank to maintain cargo suction above the cargo/water interface in a flooded tank.

In another embodiment the invention provides at least one submersible pump mounted in each cargo tank, connected to the vessel's cargo transfer piping system and means associated with the pumps to move them vertically while maintaining operability and connection to the cargo transfer system to continue the capability of removal of cargo from a holed cargo tank regardless of the water bottom therein.

The objects and specific advantages of this invention will become better understood to those skilled in the art by reference to the following detailed description when viewed in light of the accompanying drawings wherein:

BRIEF DESCRIPTION OF THE FIGURES

FIG. 5 is a view similar to FIG. 3 illustrating another variation in accordance with the invention; and FIG. 6 is a view similar to FIG. 5 illustrating yet another variation in accordance with the invention.

DETAILED DESCRIPTION OF A PREFERRED EMBODIMENT

Figure 1:
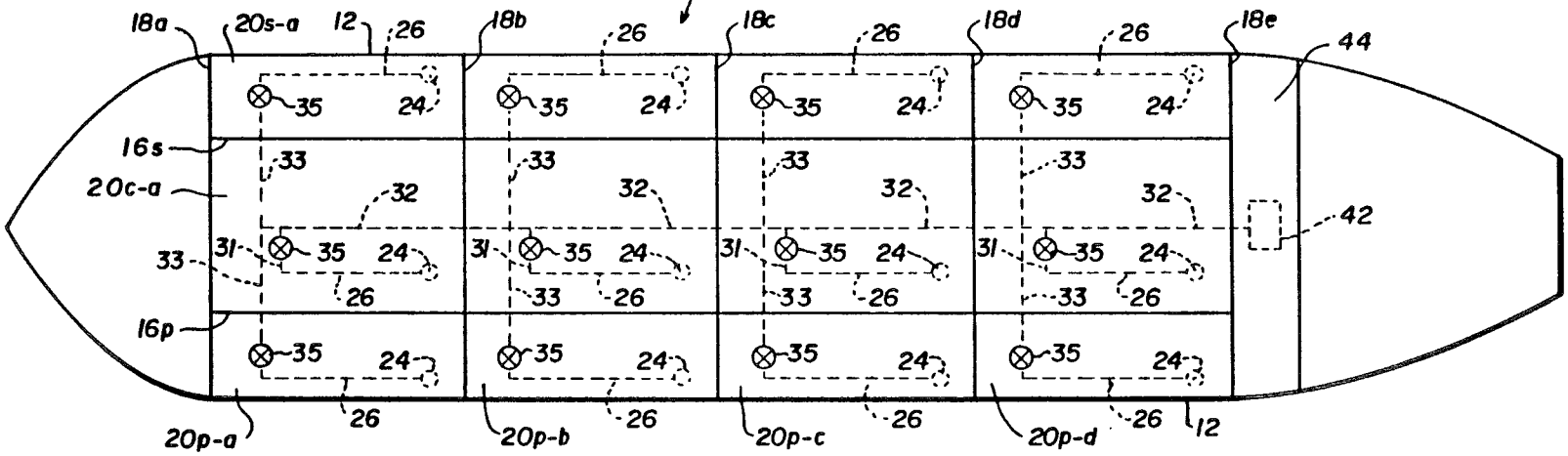
FIG. 1 is a schematic plan view of a tankvessel embodying a system in accordance with the invention.

In FIG. 1, a tankvessel, shown generally at 10, comprises hull side walls 12 and a hull bottom 14 (FIG. 2) formed in a conventional manner to make up a buoyant vessel hull structure. The hull is divided by starboard and port longitudinal bulkheads 16*s* and 16*p* respectively which intersect hull-dividing transverse bulkheads 18*a* through 18*e* to form twelve independent cargo tanks 20*s-a, c-a* and *p-a* (starboard wing, center and port wing, row a) through 20*s-d, c-d* and *p-d* (starboard wing, center and port wing, row d) as shown. The number, layout and relative size of the cargo tanks may vary from vessel to vessel. Most tank barges, for example, have only a centerline longitudinal bulkhead and port and starboard tanks. The layout illustrated is exemplary of the arrangement common in most tankships. Deck 22 (FIG. 2) forms the tank top cover to complete the enclosure of the cargo tanks.

A cargo handling system comprising conventional manifolding selectively communicative at one end thereof with a central cargo pump 42 located in a pump room 44 located thwartships immediately aft of the cargo tanks 20*s-d*, 20*c-d* and 20*p-d* and at the other end thereof through branch manifolds and valving with suction intakes in each of the cargo tanks. The cargo handling system including manifolding and pump 42 is horizontally situated at a level proximate the hull bottom 14 (FIG. 2) to minimize lift problems with cargo in the bottoms of the tanks.

Referring again to FIG. 1, the manifolding of the cargo handling system comprises a main, longitudinal manifold 32 extending from the pump room 44 forward through the center tanks to center tank 20*c-a*. Branch manifolds 33 connected to the main manifold, extend transversely to the port and starboard at the forward end of each center tank to provide communication with the port and starboard wing tanks. Branch manifolds 31 connect to the main manifold in each center tank to provide communication with the respective center tank. Valving 35 in each branch manifold 31 and 33 provides selective communication between the tanks, the manifolding system and ultimately the cargo pump 42. Mechanical valve actuators situated on the deck above each valve (not shown) may be linked to each valve for operation thereof or motor-operated valves with remote operation from a control room may be provided as desired for selective opening and closure of the valves. The details of the cargo handling system described thus far are conventional and well understood by those skilled in the art. Since they do not constitute the inventive concept of this invention, they are therefor not described or shown in greater detail further herein.

There are also many ancillary structures and systems forming necessary parts of modern tankvessels which, for the purposes of clarity, have also been omitted since they do not constitute part of the inventive concept of this invention. These omitted elements include stiffeners, stringers, web frames and other structural details; stripping systems, inert gas systems, and crude oil washing systems; accommodation, engine room and pump room spaces; and non-cargo carrying tanks such as forepeak tanks and dedicated ballast tanks and the like.

Although specifically described as applied to cargo tanks of bulk liquid-carrying tankvessels, this invention applies equally to bunker fuel tanks in all classes of motor powered vessels which, although not shown, are configured somewhat like the cargo wing tanks illustrated but are located generally abeam of the engine room spaces (aft in FIG. 1).

Figure 2:
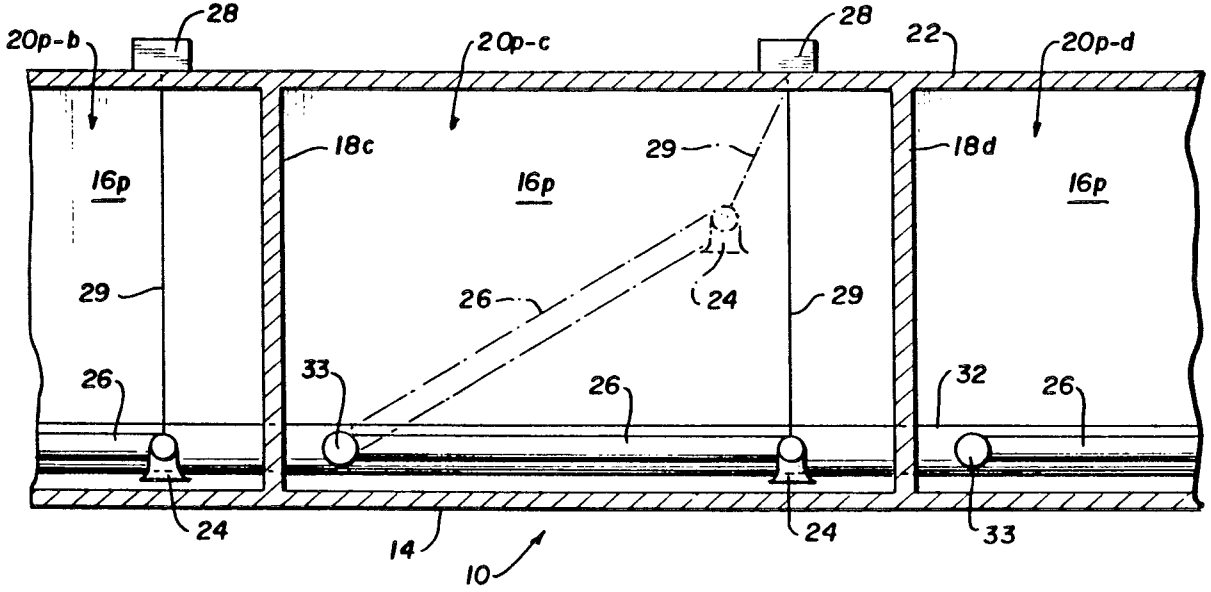
FIG. 2 is and enlarged fragmentary side elevational view of the tankvessel of FIG. 1.

Referring now to FIG. 2, the embodiment of FIG. 1 is shown in enlarged detail in port wing tank 20*p-c*. An elongated tubular arm 26 is pivotally connected to and communicative with the branch manifold 33 (FIG. 1) at one end thereof. A bellmouth suction intake 24 is pivotally mounted to and communicative with the other end of the arm. The suction is, in turn, connected to an actuator 28 by a wire 29 through which it can be elevated it from the position shown in solid line proximate the bottom of the tank through the position shown in dotted lines substantially spaced from the tank bottom.

The actuator 28 may be hydraulically or electrically powered as is deemed most suitable, so long as it is capable of performing the required manipulations of the arm 26 indicated. The bellmouth 24 is preferably linked, mechanically or hydraulically, to the arm 26 in such a way that it remains substantially level regardless of the position of the arm as is illustrated in the drawing. The branch manifold 33 (FIG. 1) is communicative with the main manifold 32 which connects to the remainder of the vessel's cargo-handling system for transmission of cargo drawn in through the manifold to other tanks or over the rail ashore or lightering vessels.

Figure 3:
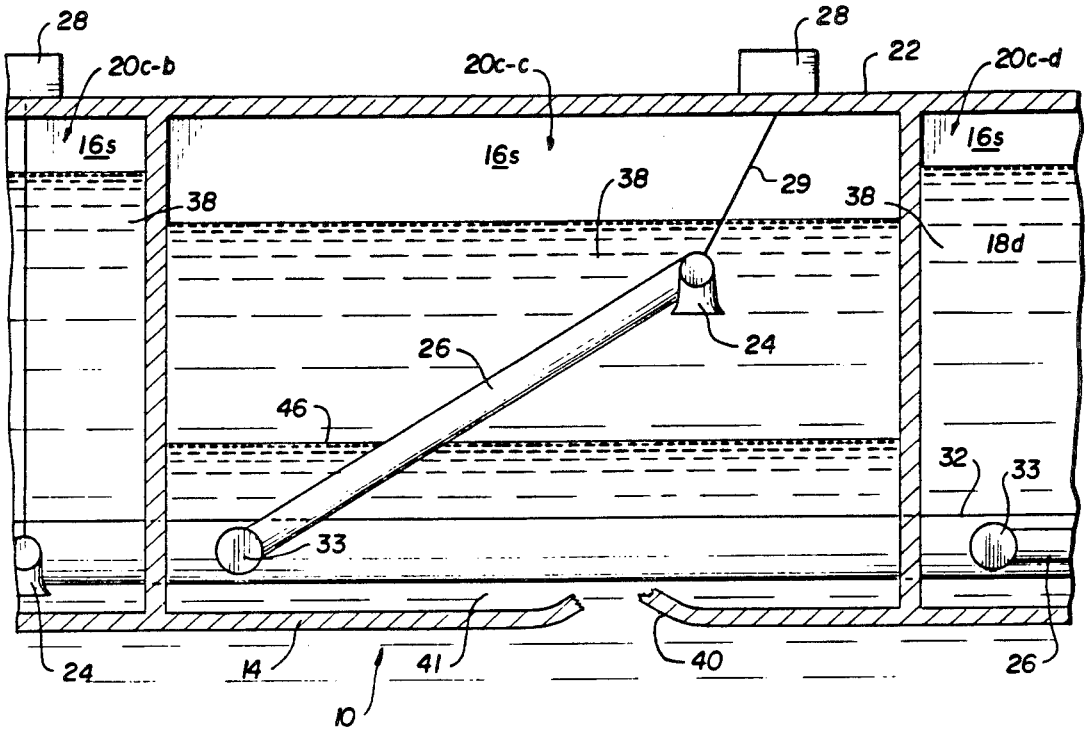
FIG. 3 is a view similar to FIG. 2 illustrating the operation of the invention thereof.

The operation of the invention is illustrated in FIG. 3. In that Figure, the tankvessel is loaded with an oil cargo 38 as shown in each of the tanks. Tank 20*c-c* has been holed by a casualty at 40 and seawater 41 has entered the tank, displacing a portion of the oil cargo and forming a water bottom with an oil/water interface at 46.

The level of the oil/water interface is a function of the level of the highest penetration of the hull. The natural interface will be somewhat above the damage level since the action of waves, current and the motion of the ship, if any, will result in discharge of cargo above that point. An interface two or three feet above the highest point of damage would be expected in all but the quietest of waters. For bottom damage such as that illustrated, water will flow in and displaced oil will flow out until a natural equilibrium interface based on relative motion between the water and the ship as described above. The greater the relative motion, the higher the natural equilibrium interface and the greater the resulting water bottom in the tank. The problem with the natural interface is that it is unstable and will continue to be upset by relative motion between the water and the vessel or any change in trim of the ship raising the draft of the ship in the area of the holed tank.

This instability will lead to continued displacement of the cargo by water and a continuing resulting spill if there are currents, seaway, movement of the ship or adverse changes in trim of the ship. Salvage efforts are therefor severely restricted until the interface can be stabilized if further oil spillage is to be minimized.

In the case of EXXON VALDEZ ample extra tankage was immediately available in the form of other tankers and barges but transfer from the damaged tanks had to await the arrival of emergency "over the top" pumping resources in the form of high capacity hydraulically driven submersible pumps by airlift from the lower 48 states. Sufficient slack tankage was available on board EXXON VALDEZ to accommodate enough of the cargo from damaged tanks to stabilize the oil water interface immediately, however, her cargo-handling system was disabled in those tanks because the water bottoms therein immersed the bellmouth intakes.

As can be seen from the normal cargo working positions of the bellmouths 24 in cargo tanks 20*c-b* and 20*c-d* in FIG. 3, the oil/water interface in cargo tank 20*c-c* would be above the pump in that tank in its normal position. By elevating the arm 26 in that tank, the bellmouth 24 has been raised to a point back in the oil cargo 38 where cargo can be reduced to raise the interface level and stabilize it. As sufficient tankage becomes available, the remaining cargo in the tank can be removed continuing to raise the bellmouth 24 until no skimmable oil remains in the tank. In an emergency, should insufficient slack tankage be available, the vessel could rig to transfer cargo to her dedicated ballast tanks or sufficient slack tankage to allow stabilization of holed tanks could be mandated. As another alternative, the vessel could be required to be equipped with bladders for this purpose.

Figure 4:
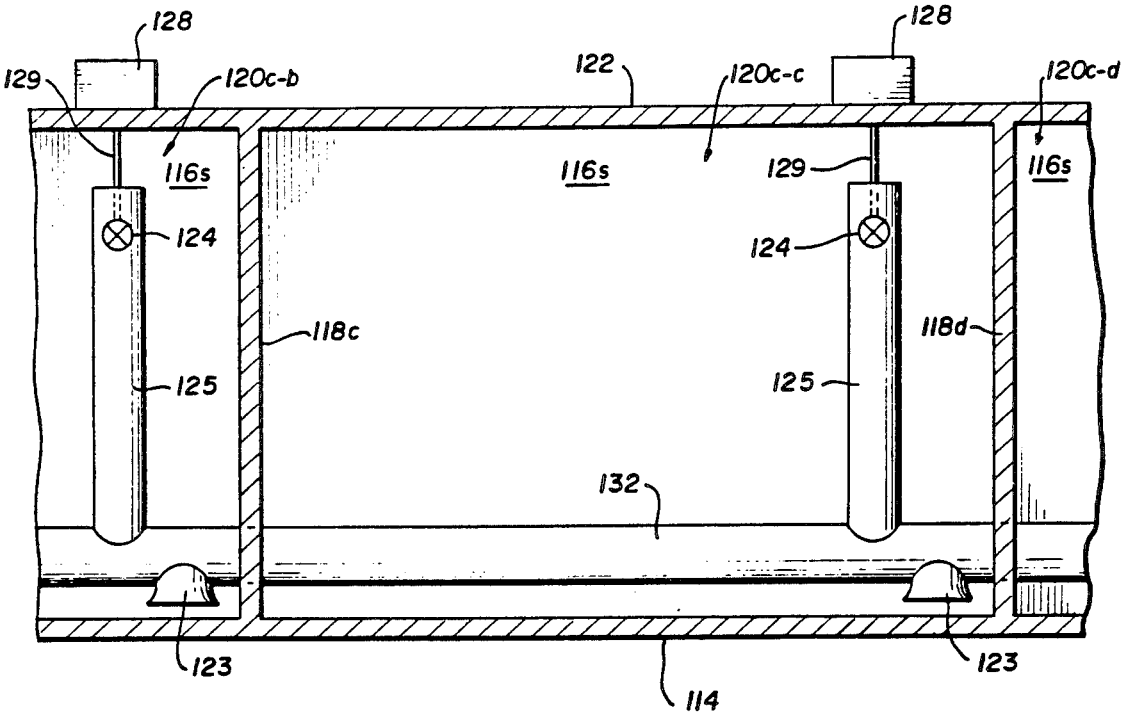
FIG. 4 is a view similar to FIG. 2 illustrating a variation in accordance with the invention.

FIG. 4 is a view similar to FIG. 2 illustrating the simplest embodiment of the invention. Components of this embodiment which correspond to similar components of the embodiment of FIG. 2 are indicated by like numerals of the next higher order and wherein a conventional bellmouth intake 123 is located for normal cargo handling beneath and communicative with the main manifold 132 through branch manifolds 131 and 133 (not shown) in each tank. The intake and associated plumbing and valving constitute conventional tankvessel cargo handling hardware standard in the art. Since the above-described system does not constitute part of this invention, it is not described or shown in greater detail. Tubular standpipes 125 are mounted on the branch manifolds and communicative with the manifold 132 in each tank. An actuator 128 connects with the standpipe 125 through a rod 129.

The standpipe 125 is closed at the top end and open at the bottom end where it sealably engages the manifold system. The standpipe is provided with a valved, normally closed orifice 124 at the upper end thereof as shown. The rod 129 extends through an opening (not shown) in the top of the standpipe 125 and connects to the valve in the valved orifice 124 such that the orifice may be opened or closed to control communication between the interior of the standpipe and the tank by operation of actuator 128.

In its normal cargo handling configuration, the valved orifice 124 is closed thereby blocking communication between the tank and the standpipe 125. Normal communication between the cargo-handling system through the manifold 132 is conducted by actuation of conventional valves (not shown) to provide communication with the tank through the bellmouth 123 in that tank. Again, this portion of the system is conventional and may be of any type standard in tankvessels as is well known to those skilled in the art.

The standpipe functions to raise the level of communication of the manifold 132 with the interior of the tanks when they are flooded as shown in the condition of the tank 20*c-c* in FIG. 3. This is accomplished in the embodiment of FIG. 4 by closing communication with the bellmouth 123 through the conventional valving system and opening the valved orifice 124 through the actuator 128 and connecting rod 129. The raised level communication between the tank and the cargo-handling system will allow removal of cargo from above the cargo/water interface which, as cargo is removed, will raise until it reaches the level of the orifice 124.

The orifice 124 may be positioned at any level desired. If, for example, it is desired to locate the orifice such that substantially all of the cargo may be pumped out in the event of a flooding, the orifice should be located as high in the tank as cargo could conceivable be located. If the intention is only to provide sufficient cargo removal to raise the cargo/water interface to a point where it is stable enough to allow working of the ship, the orifice may be positioned at a lower point in the tank. It is envisioned that a standpipe may be provided with multiple vertically-positioned orifices (not shown) and means to selectively open a required orifice to control the orifice level if such control is desired.

FIG. 5 is a view similar to FIG. 4 illustrating still another embodiment of the invention in which like components thereof are indicated by like numerals of the next higher order and wherein a submersible pump 224 is pivotally located at the lower end of tubular arm 226. Arm 226 is connected to an actuator 228 at its upper end which can elevate it from the position shown in tank 220*c-c* through the position shown in dotted lines in that tank to a position where it is substantially parallel to the deck 222.

The embodiments of FIG. 5, as well as that of FIG. 6 to be described hereinafter, are particularly suited for use with flexible tankvessel cargo protection bladders and bags such as that disclosed in the inventor's U.S. Pat. No. 4,347,798 for Buffer System for Tankvessels. In such devices, the bellmouth intake suctions must be moveable to conform to varying flexible tank configurations in any event. An emergency system such as illustrated in the embodiments of FIGS. 5 and 6 would provide the mobility required by the flexing tank and, at the same time, provide the benefits of extending the cargo system cargo handling capability in a flooded tank should a severe casualty rupture the integrity of the buffer system.

The pump may be of any of the submersible, pumps known in the art and powered either by hydraulic or electric means as is determined most suitable. High capacity centrifugal pumps such as the Frank Mohn Frammo TK-6 or the or similar pumps manufactured by Thune-Eureka will be suitable for the purposes of the invention. Where the system is intended for use as the primary cargo-handling system, multiple pumps in each tank or pumps of larger capacity, designed along the lines of those identified above, may be used for the purposes of the invention. The actuator 228 may also be hydraulically or electrically powered as is deemed most suitable, so long as it is capable of performing the required manipulations of the arm 226 indicated. The pump 224 is preferably linked, mechanically or hydraulically, to the actuator such that it remains substantially level regardless of the position of the arm is illustrated in the drawing. The discharge of the pump 224 is sealably connected to the interior of the arm 226 which is, in turn, sealably connected to a vertical manifold 230 at its upper end. The vertical manifold is, in turn, connected to a main manifold 232 on deck which connects to the remainder of the vessel's cargo-handling system for transmission of cargo discharged from the pump 224 to other tanks or over the rail ashore or lightering vessels.

Power conduits 234 for the pump 224 are connected along the arm 226 to furnish motive power for the pump. Means (not shown) may be provided at the pump 224 to sense the cargo/water interface to insure the proper positioning of the pump when it is operating in an emergency cargo pump-out situation. Such means may be any differential liquid sensing devices known in the art, such for example, as the inventor's Stratified Fluid Interface Recorder disclosed in U.S. Pat. No. 4,287,756.

FIG. 6 is a view similar to FIG. 5 illustrating yet another embodiment of the invention in which like components thereof are indicated by like numerals of the next higher order an wherein 324 is a submersible pump connected to a vertical manifold 330 through a flexible discharge hose 326 which winds on a powered reel 328 as shown. The pump 324 is slideably mounted on a vertical rod 336 which is fixed at least to the deck 330 at its upper end. As in the preceding embodiment, the vertical height of the pump is adjustable to maintain suction on the cargo as may be required.

From the above descriptions, it is obvious that various alternative mechanical structures could be substituted to achieve the ends of this invention. Rather than the swinging arm illustrated in FIG. 5, the pump 324 could be mounted on a telescoping vertical arm for example. It should be therefore understood that the invention may be practiced other than as specifically described.

What is new and therefore desired to be protected by Letters Patent of the United States is:

1. In a vessel having a hull deck and bulkheads defining side, top and bottom walls of at least one liquid-carrying tank therein and liquid-handling means including inlet means in said tank and suction, manifold and valve means situated beneath said deck closer to said bottom wall than said top wall for providing selective communication between said suction means and said inlet means for movement of liquid to and from said tank, the improvement comprising means associated with said liquid handling means in said tank to re-locate said inlet means between a normal liquid-removal position proximate the bottom of said tank and an emergency liquid-removal position spaced from the bottom of said tank to provide continued removal of liquid therefrom in the event of flooding by seawater upon rupture of said tank.

2. Means in accordance with claim 1 wherein said manifold means is disposed in a horizontal plane proximate the bottom of said tank and wherein said suction means comprises a central pump means selectively communicative with said inlet means through said manifold and valve means.

3. Means in accordance with claim 2, wherein said means to re-locate said inlet means comprises an elongated tubular arm mounted to and communicative with said manifold means at one end and movable at the other end between said normal and said emergency liquid-removal positions, said inlet means being mounted to and communicative with the interior of said other end of said arm and means to move said other end between said positions.

4. Means in accordance with claim 3 wherein said elongated arm is pivotally mounted to said manifold means, said arm being swingable to locate said inlet means between said normal and said emergency liquid-removal positions.

5. Means in accordance with claim 1 wherein said vessel is a bulk liquid cargo-carrying tankvessel and wherein said at least one liquid-carrying tank includes plural cargo tanks.

* * * * *